US008550331B2

(12) United States Patent
Smith et al.

(10) Patent No.: US 8,550,331 B2
(45) Date of Patent: Oct. 8, 2013

(54) FOLDABLE CONTAINER AND ATTACHMENTS

(75) Inventors: Daniel T. Smith, Battle Creek, MI (US); Eric A. Rosendall, Grand Ledge, MI (US); Dennis M. Kaltman, Princeton, NJ (US); Richard C. Thibault, Westchester, PA (US); John R. Widener, Haslett, MI (US); Carol J. Moore, Grand Rapids, MI (US)

(73) Assignee: Multi Packaging Solutions, Inc., Lansing, MI (US)

( * ) Notice: Subject to any disclaimer, the term of this patent is extended or adjusted under 35 U.S.C. 154(b) by 89 days.

(21) Appl. No.: 13/112,639

(22) Filed: May 20, 2011
(Under 37 CFR 1.47)

(65) Prior Publication Data

US 2012/0292378 A1 Nov. 22, 2012

(51) Int. Cl.
*B65D 5/22* (2006.01)
*B65D 5/42* (2006.01)
*B65D 5/475* (2006.01)

(52) U.S. Cl.
USPC . 229/175; 229/114; 229/117.19; 229/117.24; 229/117.25; 229/186; 229/931

(58) Field of Classification Search
USPC ..... 229/114, 175, 176, 186, 931, 117.19, 229/117.23, 117.24, 117.25, 914; 206/427, 206/476, 485, 485.1, 562–565, 784
See application file for complete search history.

(56) References Cited

U.S. PATENT DOCUMENTS 329,559 A 11/1885 Hohesnstein
1,046,017 A 12/1912 Reber
1,778,462 A 10/1930 Nourse et al.
1,833,492 A * 11/1931 Miller ..... 229/174
2,039,971 A * 5/1936 Meinhardt ..... 229/117.19
2,151,472 A 3/1939 Hubbard
2,189,602 A 2/1940 Denny
2,218,360 A * 10/1940 Rokol ..... 229/117.22
2,306,624 A 12/1942 Grover
2,334,425 A 11/1943 Lowey
2,354,867 A * 8/1944 Larkin ..... 229/117.22
2,391,767 A 12/1945 Beerend
2,405,310 A * 8/1946 Larkin ..... 229/117.19

(Continued)

FOREIGN PATENT DOCUMENTS

DE 7819435 U1 10/1978
DE 9011923 U1 10/1990

(Continued)

OTHER PUBLICATIONS

Related PCT Utility U.S. Appl. No. 09/64420, filed Nov. 13, 2009; Published as WO2011/037594 on Mar. 31, 2011.

*Primary Examiner* — Gary Elkins
(74) *Attorney, Agent, or Firm* — The Dobrusin Law Firm, PC

(57) ABSTRACT

A foldable packaging which may include a liquid-resistant paperboard form that is foldable to provide an attractive stackable container that resists water leakage, can be assembled without fastening hardware and has concealed gussets. The packaging can be folded into overlapping flaps and wings which are folded and interlocked to define a generally trapezoidal packaging which can receive a variety of different pot sizes and types. The packaging may include a handle having an elongated strip, a gripping portion, one or more widened portions adjacent the gripping portion; a bulbous portion and a narrowing head portion.

20 Claims, 10 Drawing Sheets

(56) References Cited

U.S. PATENT DOCUMENTS

| | | | | | |
|---|---|---|---|---|---|
| 2,443,256 | A | * | 6/1948 | Lebold | 206/198 |
| 2,536,530 | A | | 1/1951 | Bergstein | |
| 2,621,783 | A | | 12/1952 | Buttery | |
| 2,702,663 | A | * | 2/1955 | Klein | 229/176 |
| 2,746,638 | A | * | 5/1956 | Champlin et al. | 206/165 |
| 2,788,934 | A | * | 4/1957 | Cain | 229/117.19 |
| 2,942,769 | A | | 6/1960 | Kuchenbecker | |
| 2,944,719 | A | | 7/1960 | Arneson | |
| 2,954,914 | A | * | 10/1960 | Herlihy | 229/117.17 |
| 3,091,381 | A | | 5/1963 | Sidney | |
| 3,291,369 | A | | 12/1966 | Crawford | |
| 3,314,194 | A | | 4/1967 | Halleck | |
| 3,338,503 | A | | 8/1967 | Beh | |
| 3,412,921 | A | * | 11/1968 | Rekow | 229/165 |
| 3,443,681 | A | | 5/1969 | Wysocki | |
| 3,465,948 | A | | 9/1969 | Boyer | |
| 3,559,869 | A | * | 2/1971 | Reynolds | 229/119 |
| 3,567,106 | A | | 3/1971 | Anderson | |
| 3,606,078 | A | | 9/1971 | Phillips, Jr. | |
| 3,754,642 | A | | 8/1973 | Stidolph | |
| 3,869,828 | A | | 3/1975 | Matsumoto | |
| 3,913,823 | A | | 10/1975 | Lin | |
| 3,993,240 | A | | 11/1976 | Matsuyama | |
| 4,055,293 | A | | 10/1977 | Stramaglia | |
| D249,022 | S | | 8/1978 | Bamburg et al. | |
| 4,119,265 | A | | 10/1978 | Dlugopolski | |
| 4,238,069 | A | * | 12/1980 | Morris, Jr. | 229/117.15 |
| 4,242,835 | A | | 1/1981 | Mondragon | |
| 4,260,098 | A | | 4/1981 | Manizza et al. | |
| 4,512,511 | A | | 4/1985 | Zimmermann | |
| 4,586,650 | A | | 5/1986 | Sasaki et al. | |
| 4,919,267 | A | | 4/1990 | Stoll | |
| 4,974,772 | A | | 12/1990 | Spurrell et al. | |
| D317,582 | S | | 6/1991 | Weder | |
| 5,029,708 | A | | 7/1991 | Alonso et al. | |
| 5,070,645 | A | | 12/1991 | Vaughn | |
| D326,246 | S | | 5/1992 | Weder | |
| D326,830 | S | | 6/1992 | Vaughn | |
| D327,234 | S | | 6/1992 | Vaughn | |
| D327,236 | S | | 6/1992 | Weder | |
| 5,174,061 | A | | 12/1992 | Dambricourt | |
| 5,211,330 | A | | 5/1993 | Frey | |
| 5,221,248 | A | | 6/1993 | Weder et al. | |
| 5,254,072 | A | | 10/1993 | Weder et al. | |
| 5,284,294 | A | | 2/1994 | Floyd | |
| D360,387 | S | | 7/1995 | Weder et al. | |
| D361,738 | S | | 8/1995 | Shryock | |
| D363,450 | S | | 10/1995 | Weder et al. | |
| 5,673,847 | A | | 10/1997 | Swink | |
| D398,261 | S | | 9/1998 | Weder et al. | |
| 5,853,121 | A | | 12/1998 | Francisco | |
| 6,050,483 | A | | 4/2000 | Haraldsson et al. | |
| 6,345,467 | B1 | | 2/2002 | Weder | |
| 6,421,959 | B1 | | 7/2002 | Van Laere | |
| 6,561,353 | B2 | | 5/2003 | Levieux et al. | |
| D480,660 | S | | 10/2003 | Faulkner | |
| 6,745,514 | B1 | | 6/2004 | Myrland | |
| 6,782,659 | B2 | | 8/2004 | Van Laere | |
| D572,169 | S | | 7/2008 | DeRoeck | |
| D630,548 | S | | 1/2011 | Kaltman et al. | |
| 7,870,995 | B1 | | 1/2011 | Kaltman et al. | |
| D631,741 | S | | 2/2011 | Hubbard et al. | |
| D631,743 | S | | 2/2011 | Hubbard et al. | |
| 7,959,061 | B2 | | 6/2011 | Kaltman et al. | |
| D650,665 | S | | 12/2011 | Kaltman et al. | |
| 2002/0038527 | A1 | | 4/2002 | Weder | |
| 2002/0148159 | A1 | | 10/2002 | Weder | |
| 2002/0184821 | A1 | | 12/2002 | Campeau | |
| 2003/0197053 | A1 | | 10/2003 | Haraldsson | |
| 2004/0031842 | A1 | | 2/2004 | Westerman et al. | |
| 2004/0182916 | A1 | | 9/2004 | Roseth | |
| 2008/0060270 | A1 | | 3/2008 | Weder | |
| 2011/0072719 | A1 | | 3/2011 | Kaltman et al. | |
| 2011/0089227 | A1 | | 4/2011 | Kaltman et al. | |
| 2012/0125804 | A1 | | 5/2012 | Kaltman et al. | |

FOREIGN PATENT DOCUMENTS

| | | | |
|---|---|---|---|
| EP | 1084958 | A1 | 3/2001 |
| EP | 2480461 | A1 | 8/2012 |
| GB | 477926 | A | 1/1938 |
| GB | 490316 | A | 8/1938 |
| GB | 714265 | A | 8/1954 |
| GB | 2121383 | A | 12/1983 |
| GB | 2276870 | A | 10/1994 |
| GB | 2415956 | A | 1/2006 |
| WO | 02/076840 | A1 | 10/2002 |
| WO | 2011/037594 | A1 | 3/2011 |

* cited by examiner

FOLDABLE CONTAINER AND ATTACHMENTS

FIELD OF THE INVENTION

The present invention relates generally to foldable carrying containers, and more specifically to a liquid-resistant paperboard form that originates in a flattened format but can be folded to form a carrying container including a packaging and handle.

BACKGROUND OF THE INVENTION

Paper based packaging materials are frequently utilized for containing and/or transporting a wide range of consumer goods. The paper based nature of these packaging materials results in products that are relatively lightweight, inexpensive, reasonably sturdy and can be easily disposed of and/or recycled. Many of these packaging materials are produced in a flat format and can be folded to create a container. However, there are a number of disadvantages to foldable paper packaging. Any paper material that is pliable enough for easy folding is usually not strong enough to withstand substantial weight or pressure. Further, many paper packaging products are incapable of containing liquids given the risk of degradation to the paper material upon extended liquid contact or the risks associated with paper's propensity for tearing. Paper packaging also tends to be imprecise in adjusting to fit a range of product sizes such that additional packing materials and/or lids are required to ensure that a product is maintained within the packaging. In addition, most foldable paper packaging includes no handling device for carrying the packaging. Those that do include a handle generally have a rigid handle that requires separate external attachment mechanisms for attaching the handle to the packaging or alternatively, a handle that is integrated and cannot be removed from the packaging.

To facilitate folding and carrying, many foldable paper packages will employ external features, such as gussets to help define corners and rigid external attachment mechanism to connect handles to the packaging. In some instances such external gussets and attachment mechanisms have the potential to detract from the aesthetic appeal of the container. These external structures also have a relatively large potential to snag against an object when moved and cause disassembly to occur. The presence of external gussets and attachment mechanisms further has the potential to attract and accumulate externally visible dust or other matter when stored over extended periods.

It is also common that paper based packaging products are shaped in a way that renders them un-stackable in folded format and un-stackable upon addition of a handle. Further, many paper based containers include an integrated lid for maintaining contents within the container.

U.S. Pat. No. 5,853,121 discloses a foldable packaging product purporting to have a leak proof corner construction to act as a temporary cooler for carrying food products. The paperboard cooler includes externally visible locking tabs and no mechanism for maintaining a product securely within the cooler, other than an integrated lid and handle portion. Further, as the drawings depict, the corner gussets are folded on the exterior of the cooler to prevent food and other contents from slipping between folds and possibly contaminating the cooler.

U.S. Pat. No. 4,119,265 discloses a foldable packaging purporting to be leak-proof. However, the packaging includes gussets that are folded along the exterior surface of the packaging (as shown in the drawings) and an integrated attached closure structure. Further, the box includes no handle and no mechanism for maintaining any items within the packaging, other than a standard integrated lid. The packaging is intended for food shipment.

U.S. Pat. No. 3,559,869 discloses a foldable beverage cooler having an open top portion. The cooler includes no handle and no means for maintaining items within the cooler.

Paper based foldable carrying and packaging solutions may be designed to house one or more specific articles of a known size. This may be acceptable for applications in which the contents are of a standardized size and/or geometry. However, for containing some items, use of these is impractical due to wide variations in content configuration. For example, in the packaging and sale of horticulture products, such as potted plants, floral arrangements or other bouquet arrangements, additional considerations are raised. First, the arrangements tend to be placed in a pot having no handle for carrying which may often be shaped plastic container. Such containers come from a wide range of sources and the industry is not standardized. As a result, pots are manufactured in an untold number of varying heights, diameters, or other sizes.

Accordingly, in view of the above, there exists a need for product packaging which overcomes some or all of the above drawbacks in the art. For example, there is a need for a packaging that includes a carrying means and an attractive exterior surface that contains no externally visible folds, tabs, attachment mechanisms or other structural features. There is also a need for a product packaging that can contain an article without an integrally attached lid. There is a further need for packaging that can maintain contact with liquids for extended periods of time without material degradation or leaking.

SUMMARY OF THE INVENTION

The present invention meets some or all of the above needs by providing a packaging that includes a base portion, a plurality of side walls, at least one article retention structure integrally formed in the packaging that can secure a position of at least one article within the interior of the packaging or accept a flexible, detachable handle portion and wherein the article retention structure concealed from exterior side viewing.

Advantageously, the packaging may be formed (e.g., die-cut, scored and/or pre-broken) from a single sheet form (e.g., a coated paperboard form) having a liquid resistant material defining at least a portion of at least one inwardly facing surface. The handle portion may also be formed of a paperboard material. The handle portion may include a grasping portion and two end portions located adjacent the grasping portion. The end portions may include a narrowing head portion with flexible tabs located on opposing side edges of each head portion and a bulbous portion located adjacent the head portion. The article retention structure may include a slot defined in the free end flap portion that has an upper edge so that flexible tabs of the handle are maintained behind the upper edge so that upon application of upward force to the handle, the head portion remains within the article retention structure. The bulbous portion remains in front of the upper edge and external article retention so that only the narrowing head portion is located within the article retention structure.

Not only does the above provide a handle that can be easily added to and removed from the packaging with no damage to the packaging, but also no externally visible structures or features are required to attach the handle to the packaging.

By way of a specific example, without limitation, the teachings herein will illustrate a liquid resistant packaging comprising: a base portion, a plurality of side walls and at least one inwardly folded gusset attached to and disposed between adjoining side walls. At least two of the sidewalls each it at least one inwardly folded free end flap portion that includes at least one article retention structure integrally formed in the at least one free end flap for engaging a handle. The handle includes a grasping portion and two end portions located adjacent the grasping portion and having a narrowing head portion with flexible tabs located on opposing side edges of the head portion and a bulbous portion located adjacent the head portion. The article retention structure is concealed from exterior side viewing and includes a slot defined in the free end flap portion that has an upper edge so that flexible tabs of the handle are maintained behind the upper edge so that upon application of upward force to the handle, the head portion remains within the article retention structure.

Also contemplated within the scope of the teachings herein are generally planar sheet forms that are shaped and scored so that the form folds upon itself to form a packaging as described herein. Further contemplated are planar handles having sufficient flexibility to form a curved handle for removable attachment to the folded packaging. The process of making the forms, handles, and packaging are also within the present teachings. A variety of uses are made possible by the teachings herein including but not limited to using packaging to contain and carry one or any combination of a potted plant, a bouquet, a gift or gift assortment, promotional materials, wedding favors, party favors, other large event favors, or handouts.

The packaging herein offers any of a number of benefits and advantages, including but not limited to one or any combination of the following: the handle may be formed as a planar surface and curved in use; the handle may be attached and detached from the packaging any number of times with no damage to the packaging attachment of the handle requires no external structures or fixtures; the top of the packaging may remain pen for both expanded contents space and display purposes; the top edge that is distal from the base portion may be a folded/finished edge; all gussets and locking wings may be folded into the interior of the packaging so that they are concealed from view; the packaging may include interior (externally concealed) retaining means with adjustability for shape and size of the packaging contents; the packaging therefore may also include a smooth continuous outer surface thereby simplifying the addition of decorative elements to the exterior of the packaging; the packagings may be stackable so that they are able to be nestingly placed within other packagings; the packaging may include precise corners that resist crushing and bowing; the packaging may be liquid resistant so that water can be placed within the packaging without risk of leaking or material degradation; and the packaging may be assembled in a manufacturing operation requiring a relatively small footprint in as much as conveyers are unnecessary for product handling.

DETAILED DESCRIPTION

Figure 1:
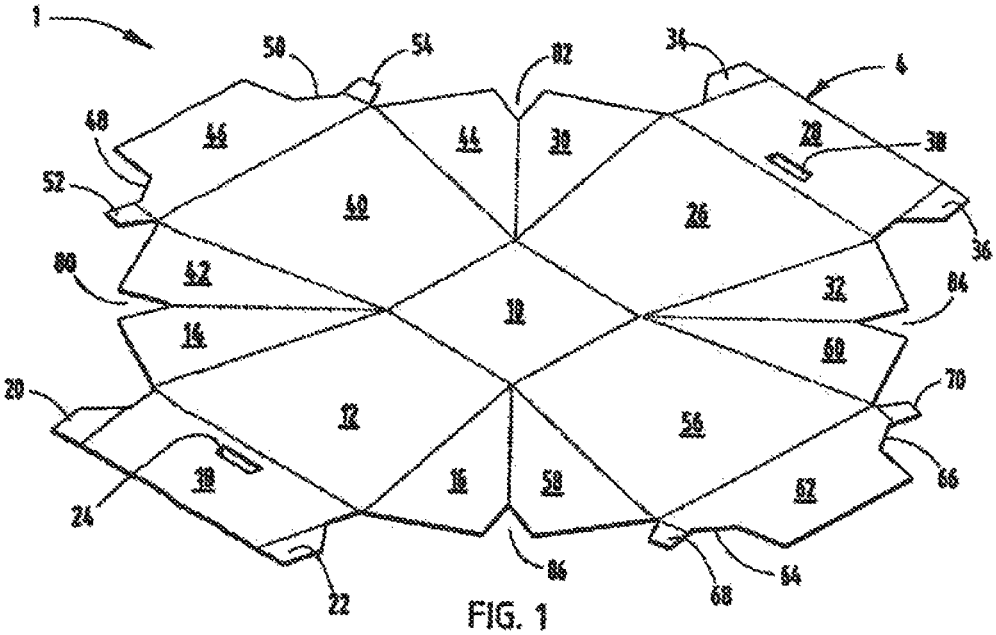
FIG. 1 is a perspective view of a die cut pattern for forming a packaging of the present invention.
Figure 2:
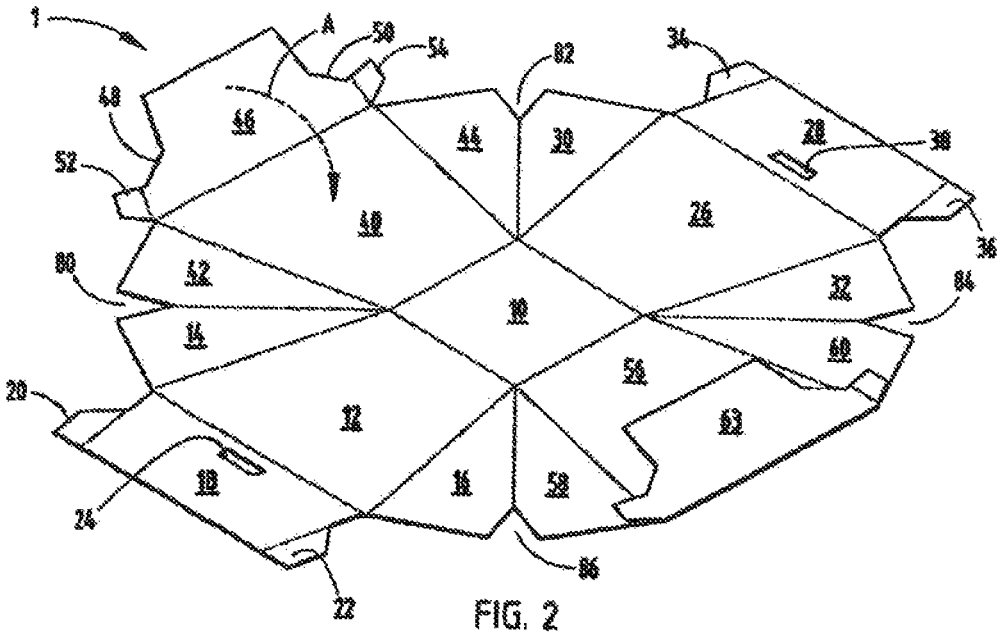
FIG. 2 is an illustration of the packaging shown during a first step of assembly.

In general, the invention described herein provides for a packaging that include a base portion, a plurality of side wails, and a removable handle. The plurality of side walls may include at least one inwardly folded gusset attached to and disposed between adjoining side walls. At least two of the sidewalls may each include at least one inwardly folded free end flap portion that includes at least one article retention structure integrally formed in the at least one free end flap for engaging a handle. The handle may include a grasping portion and two end portions located adjacent the grasping portion. The end portions may have a narrowing head portion with flexible tabs located on opposing side edges of the head portion and a bulbous portion located adjacent the head portion. The article retention structure may be concealed from exterior side viewing. The article retention structure may include a slot defined in the free end flap portion that has an upper edge so that flexible tabs of the handle are maintained behind the upper edge so, that upon application of upward force to the handle the head portion remains within the article retention structure.

The present invention further provides for a packaging that is processed to provide a container having a removable handle and being capable of maintaining liquid within the confines of the container for items requiring water or moisture contact. The packaging and handle may be made from a sheet form (e.g., a paperboard form) that initially is provided in a flat format. The paperboard is sufficiently flexible so that the handle and packaging can be folded or bent in use. The packaging and handle may typically include preselected scoring and/or openings for precise fold and/or bend lines. The packaging may thus be easily and precisely machine-folded or hand-folded to define a finished container that is attractive, durable, and capable of holding an amount of liquid without leakage for an extended period of time (e.g., 1 day, 1 week, 1 month, 3 months, or longer). One or more openings may be included on the handle to facilitate attachment of the handle to the packaging. The packaging may include a layer of material that imparts a liquid (e.g., water) resistance characteristic to the packaging.

Both the packaging and handle may be formed in a standard shape, but produced in a number of varying sizes. The packaging may further include one or a plurality of article retention structures so that it may contain any of a wide range of product sizes within it. The length of the handle may also vary to accommodate contents having a variety of heights, depending upon how far the packaging contents extend beyond the top edge of the packaging. For example, the packaging may contain pots for horticultural, bouquet, or other arrangements across a range of sizes. It is also possible that the resulting packaging is capable of securely fitting and locking in place a sped size range of products without the need for additional packing materials or coverings.

The handle may be a singular elongated strip having a length that is greater than the width of the handle at any point along the handle. The handle includes two end portions at opposing ends of the strip and two side edges along the strip. The handle may include a centrally located grasping portion that is shaped to correspond to a carrier's hand. For example, the grasping portion may include one or more undulating side edges so that the side edges correspond to (e.g., fit) a user's fingers upon grasping of the handle. The handle may include widened portions (e.g., portions of the handle having an increased width as compared to the portions of the handle adjacent the widened portion) along the strip at each end of the grasping portion to aid a user in maintaining a secure grip along the grasping portion. For example, the widened portions may prevent the handle from sliding through or within a user's hand during use.

Each end portion of the handle may include a narrowing head portion located adjacent a bulbous portion. The bulbous portion may be located between the narrowing head portion and the widened portion of the handle. The bulbous portion may be formed by protrusions of the side edges along the handle. The protrusions may be curved or may be angled. The bulbous portion may include a to edge and a bottom edge, the bottom edge being adjacent the rowing head portion. The bulbous portion may further include two side edges which ma include at least a portion of the protrusions that form the bulbous portion.

The narrowing head portion is located adjacent the bulbous portion and is shaped to engage the article retention structure of a packaging. The narrowing head includes a top edge adjacent the bulbous portion and a bottom edge that is also a terminating end of the handle. The narrowing head portion also includes two side edges angled toward one another so that the width of the narrowing head portion decreases as it moves from the top edge to the bottom edge of the narrowing head portion. The bottom edge may be a point connecting the two side edges or may be a flat edge connected to each side edge.

The narrowing head portion, the bulbous portion or both may include one or more openings to create one or more flexible tabs that engage the article retention structures of the packaging and/or allow flexibility and bending of the handle to pr event tearing or deformation during use. The openings may be formed as slits or cuts in the material that forms the handle. The openings may be formed in a variety of different locations and direction along the end portions. As an example, the bulbous portion may include a central opening located substantially centrally within the bulbous portion. The bulbous portion may also include openings located near the edges of the bulbous portion. The openings within the bulbous portion may create a tab to provide flexibility to the end portion upon placement of the head portion within the article retention structure. The openings may thus reduce stress on the handle that might usually cause deformation or tearing of a portion of the handle in the absence of the opening. The process of locating the head portion within the article retention structure will be discussed in further detail below.

The end portion may include additional openings that provide for tab structures. These openings may be at least partially located between the bulbous portion and the head portion and may extend from an interior area of the end portion to an outer side edge of the end portion. These openings also facilitate engagement of the end portion with the article retention structure of the packaging by creating a site for removably connecting the end portion with the article retention structure. The narrowing head portion may also include an additional opening located along the center of the narrowing head portion. This opening may extend to the terminal edge of the handle. This terminal edge opening may further be connected to one or more additional openings. As an example, the terminal edge opening may be connecting to the central opening within the bulbous portion. There may also be no opening along the center of the narrowing head portion.

Prior to use of the handle, these openings may be perforated. The perforations may allow for the openings to be closed during manufacture of the handle and then opened by a user prior to use. By allowing the openings to remain closed prior to use, the tabs created by the openings may be prevented from catching onto other substrates to cause tears or undesired deformation of the handle.

As previously mentioned, the openings are present to facilitate engagement of the handle with one or more article retention structures located within the packaging. The narrowing head portion may be placed within an article retention structure of the packaging. Upon entry, tabs created by the openings along the side edges of the narrowing head portion are placed behind the upper edge of the article retention structure. Upon pulling upward on the handle, the head portion held in place by the tabs contacting the interior of the folded top edge of the packaging. When pulling upward on the handle, the tabs are held in place between the interior of the folded to edge of the packaging. When pushing downward on the handle, the protrusions of the bulbous portion prevent the bulbous portion and any portion of the handle beyond the bulbous portion from entering the article retention structure. Thus the width of the handle for at least a portion of the protrusions of the bulbous portion is greater than the largest width of the article retention structure.

Prior to folding, both the packaging and handle may be a flat sheet material (e.g., a paperboard form) that is die cut and scored to obtain the necessary shape and to impart scored fold lines. In its folded format, the packaging may include an exterior surface, an interior surface, a base portion and a plurality of side walls. The base portion of the packaging may include at least four edges connecting to at least four side walls. The plurality of side walls may be tapered such that the width of each side wall expands as each side wall extends away from the base portion. The tapered format of the side walls can allow the packaging, to contain items that also include a tapered structure. As an example, the tapered shape can allow for the packaging to contain items that are generally cylindrical or frustoconical in shape. For example, the packaging may be configured to hold a conventional pot used in horticultural applications such as potted plants.

The packaging may include corner areas or gussets that are specifically configured to allow the packaging to be folded from a sheet of material into an upright packaging including at least one base portion and one or more side walls. Upon folding, the gussets may be folded so that they are contained within the interior of the packaging so that the exterior of the packaging is substantially smooth and includes no visible indication of folding. The gussets thus may be concealed. Upon folding the gussets may fold into the packaging so that the side walls are arranged orthogonally to adjacent side walls. The gussets may be die cut to include notches (e.g., v-shaped slots) to minimize or substantially prevent overlap of the gussets at the interior of the packaging during folding, while still allowing the base material to lie in a substantially planar position prior to folding.

For further facilitating the folding process, one or more wings may be attached to one or more inwardly folded free end flaps for providing air interference fit within the interior of the container. A portion of the inwardly folded free flaps may contact a portion of one or more additional free flaps when folded. The inwardly folded free flaps may include a connected edge (connected to the side wall), a terminal edge and one or more side edges. Upon folding the flaps inward, the terminal edge may extend downward along the interior of the packaging so that it contacts or nearly contacts the interior of the base portion. The terminal edge may extend less than 80% of the height of the side wall. The terminal edge may extend less than 50% of the height of the side wall. The terminal edge may extend less than 20% of the height of the side wall. In the event that the packaging is filled with liquid, it may desirable that the terminal edge extend only to a point along the interior side wall so that it does not contact the liquid. At any point in the folding process, an adhesive may be placed between two surfaces that contact one another in the folded format of the packaging. The adhesive may include a pressure sensitive glue that is not water-soluble.

As an additional benefit of the foldable nature of the packaging and handle disclosed herein, the packaging may be free of additional hardware for attaching the handle to the packaging and/or maintaining the packaging in a folded format. The packaging and handle may be free of fasteners, closures, hooks, handles, clips, eyelets, or any other hardware. The packaging may or may not include a covering (e.g., a lid). It may be free of any integrated attached closure structure.

Figure 11:
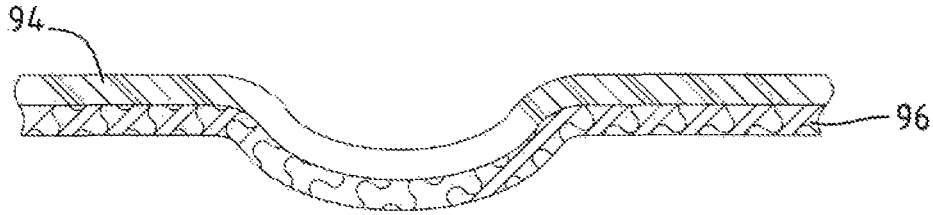
FIG. 11 is a cross-sectional view of a scored fold line depicting scoring of both a paperboard layer and a polymeric layer.

The folding process may be guided by score lines imparted into the packaging to facilitate precise folding of the packaging. The scoring may be deep enough so that the likelihood of imprecise fold lines (e.g., fold lines that waver from or extend beyond the score lines) is reduced as compared with structures that do not employ such lines. Further, the scoring depth is also sufficiently deep to avoid folds having too small of scoring depth which may result in crushed corners due to imprecise folds. The scoring depth may also be sufficiently shallow so that upon folding, any coating (e.g., a water resistant layer) on the form remains intact and does not rupture to expose underlying paperboard. In addition, it the scoring is too deep, the base substrate, any water resistant coating, or both may rupture (during scoring or from stress applied during assembly) which may result in leaking or the inability to maintain an item within the packaging. By way of example, FIG. 11 depicts a cross-sectional magnified view of a score line such that neither the water resistant layer 94 or the paperboard layer 96 are subject to rupture.

The packaging may also include a portion not intended for holding liquids, such that the packaging includes an area above which the interior material may not be treated for liquid resistance. More specifically, as described above in regard to the end flaps being folded over the folded edge to contact the interior of the side wall, the exterior of the end flaps (which post-folding may be located on the interior of the packaging) may not be treated for water resistance. Therefore, any liquid within the packaging may extend only up to the terminal edge of any end flap. Thus, the terminating edge of the end flap creates a fill line above which portions of the packaging may not be treated for liquid resistance. In areas above the fill line, the scoring may be deep enough to actually break through or perforate the base material. The scoring at such locations may be substantially variable so that areas where the base substrate has actually been fractured contacted with areas that remain connected to prevent breakdown of the packaging. For a paperboard sheet form having a thickness of from about 14 point to about 22 point, the scoring depth for at least a portion of the score lines (e.g., any score lines located below the fill line) may be greater than about 0.5 point. The scoring depth for at least a portion of the score lines may be less than about 4 point. The scoring depth for at least a portion of the score lines may be about 2 point. Any perforated portion of a score line may have a scoring depth sufficient to rupture the base substrate, the polymeric coating, or both. Any portion of a score line adjacent to a perforated portion of a score line may have a scoring depth of greater than about 0.5 point. Any portion of a score line adjacent to a perforated portion of a score line may have a scoring depth of less than about 8 point.

Figure 10:
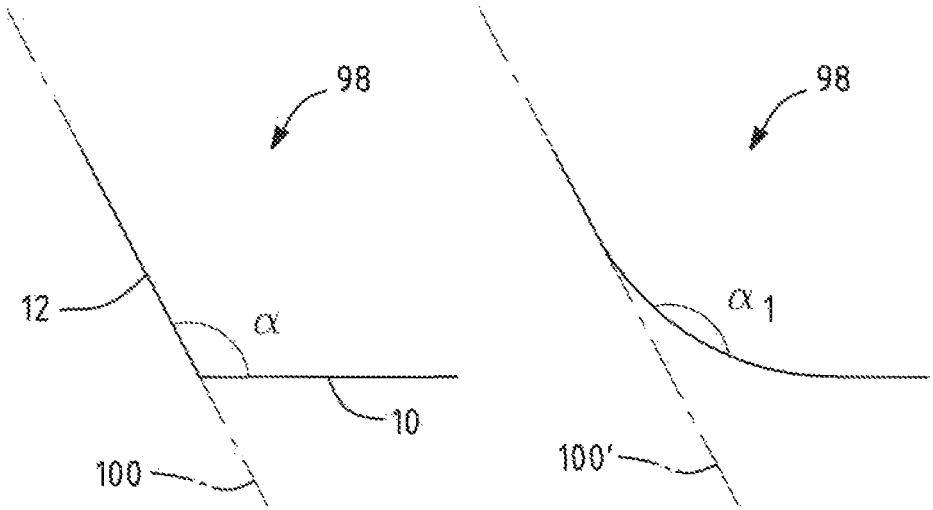
FIG. 10 is a comparative view of a precise corner illustrative of the packaging disclosed herein and a crushed corner.

The scoring and folding process may also result in a packaging displaying precise corner structures. By way of example, in FIG. 10 the corners of the packaging may have a desired angle, $\alpha$. Corners that are less precise as a result of crushing and/or imprecise scoring/folding lines may have angle of $\alpha_1$ which is at least 20°, at least 30°, at least 40°, at least 50° or more greater than the value of $\alpha$. Further, any tangent 100 drawn to the intersection of the base portion 10 with a side wall 12 may be nearly or substantially co-extensive with the side wall. As depicted in the example of the crushed corner, the tangent $\mathbf{100}_1$ may deviate from the angle and direction of the side wall.

Upon folding along the score lines, the interior of the packaging may include an article retention structure that attaches the handle to the packaging and/or secures items within the packaging. This article retention structure thus allows items to be maintained within the packaging without need for a lid (e.g., an integrally attached lid) or additional packing material. The article retention structure may be utilized to attach the handle, and upon removal of the handle, may then be utilized to maintain an item within the packaging. The handle may then be re-attached to the packaging by disengaging the item within the packaging from the article retention structure so that the end portion of the handle is placed within the article retention structure. The article retention structure may not be capable of simultaneously engaging the handle and maintaining an article within the packaging. The article retention structure may be included in a variety of locations so that handles and items over a wide range of sizes may be securely attached to or placed into a standard packaging. As an example, the packaging may be manufactured in a finite number of incrementally increasing standard sizes (e.g., three, four, five, or more standard sizes) that are adapted to receive a number of different handles and/or articles (e.g., more than four different sized pots, in the case of horticulture products). Each of these standard sizes may contain a number of article retention structures so that each standard packaging is capable of attaching a handle at numerous locations and/or securely locking items having a range of sizes.

As a specific example, for packaging designed to hold a potted plant, there is no standardization of pot sizes. Thus, a pot can be any size having nearly any circumference and diameter. In an effort to create standardized packaging that will lock a plant pot of any size into place, the packaging may include multiple article retention structures at varying heights along the interior of the packaging so that each standard size of packaging can securely fasten a range of pot sizes into place. Further, as shown for example in FIGS. 9C and 9D, the free end flaps may exhibit an ability to flex closer to and further from the side walls so that the size range of pots that may be retained by the retention structure is broadened.

The article retention structure generally will include a surface that is spaced from the base portion of the packaging (e.g., above the base portion) and will have a surface (e.g., an edge, a flange, or otherwise) that urges an article toward the base one inserted. By way of example, the article retention structure may be formed from one or more slots placed along the interior of the packaging. The slots may be cut-outs formed into the base substrate such that the top edge of a cut-out will contact an edge of item so that the item is securely maintained within the packaging with no need for a lid or additional packing material. As discussed above, the cut-outs may engage a portion of a handle to allow for carrying the packaging.

The slots may be placed on the interior of at least one side wall of the packaging. More specifically, the slots may be located on the free end flap so that upon folding inward, the slot is located on the interior of the packaging. The slots may be placed on at least two end flaps of the packaging. The slots may be placed on every end flap of the packaging. In the event that multiple slots are placed on one or more end flaps the slots may be arranged so that they are substantially parallel to one another at varying heights so that any item placed within the packaging will come into contact with one or more slots located at a height near to or equal to an edge height of the item here it contacts the interior of the packaging. The slots may further be arranged for contacting an additional attachment for use in conjunction with the packaging, such as a handle. As an example, the slots may engage a handle structure for carrying, hanging, or displaying the packaging and its contents. The slots may also be adapted to receive or otherwise carry an engaged article, such as a whimsical item (e.g., a decorative element such as flags, ribbons, candy, photos or the like).

The base substrate for forming the handle and packaging may be any material pliable enough to be scored and folded but strong enough to withstand the weight of a contained article. As an example, the handle must withstand the weight of carrying an item within the packaging, specifically the structure for engaging the handle with the article retention structure must be strong enough to be maintained within the article retention structure, but pliable enough to be flexed for placement within the article retention structure. A particular feature of the material may be that it is durable enough to hold liquids for an extended period of time without risk of leaking. The substrate may be formed of paper materials including but not limited to paperboard, chipboard, cardboard, fiberboard, natural fibers, mineral fibers or any combination thereof. The material may be a virgin material, a post-consumer recycled material, or both. The substrate material may be a recyclable material and/or a biodegradable material. If the substrate material includes paperboard, the paperboard may be a bleached or unbleached paperboard. For example it may be a solid bleached sulfate (SBS) paperboard. The material may contain a major portion that can be recycled. The base substrate material may be formed of a polymeric material including but not limited to thermoplastics, thermoset plastics, elastomeric containing materials any combination thereof. Examples of polymeric materials that may be employed include polyamide, polyester, polystyrene, polyethylene (including polyethylene terephthlate, high density polyethylene and low density polyethylene), polypropylene, polyvinyl chloride, bio-based plastics/biopolymers (e.g., poly lactic acid), silicone, acrylonitrile butadiene styrene (ABS), or any combination thereof.

The base substrate material may inherently be a water-resistant material so that no additional treatment is required to impart water resistance. The gauge of the base substrate material may vary depending on the size of the packaging or the desired strength of the packaging. As an example, if the base substrate material includes paperboard, the gauge of the paperboard may be greater than about 14 point paperboard. The gauge of the paperboard may be less than about 22 point paperboard.

Many materials, especially the paper-based materials disclosed above, may degrade upon contact with liquids and/or moisture. This may increase with constant liquid or moisture contact over an extended period of time. Thus, the base substrate material may include a layer of a material to improve liquid resistance so that it produces a paper-based packaging capable of extended contact with liquids (e.g., 1 day, 1 week, 1 month, 3 months, or longer), the base substrate material may include a layer of a material to improve liquid resistance. The packaging may include any material that may act as a water barrier or that surface treats the substrate material to impart hydrophobicity to the material.

This layer of material may be a wax material or may be polymeric material, examples of which may include rubber, polyethylene, polyurethane, polyvinyl chloride, silicone, or any combination thereof. The layer may also be biodegradable and may include cellulose, calcium, starch or combinations thereof. This layer may be applied to the interior of the packaging, the exterior of the packaging, or both. The thickness of the layer of material may be greater than about 0.005 mm. The thickness of the layer of material may be less than about 0.3 mm. The thickness of the layer of material may be greater than about 0.0127 mm. The thickness of the layer of material may be less than about 0.0508 mm. The packaging may also include additional coatings to promote the durability of the packaging such as a varnish, aqueous, or ultra violet coating. Any layer or coatings may be applied to the packaging by lamination, co-extrusion, or any coating process such as rolling, brushing, dip coating or spray coating.

The packaging and handle may be assembled at a single location or at different locations. For example, a form may be created at a first site (cutting and/or scoring facility) and then provided to a second site (a folding facility) where it is folded. The handle and packaging may be shipped or otherwise provided in a flat format, with the packaging being folded and handle being attached at a destination location. The packaging may also be partially folded prior to shipping. The packaging may be substantially completely folded and then shipped, having the handle attached or shipped unattached for attachment at a destination location. The tapered shape of the side walls in the folded format allows for multiple packagings to be nested within one another during production and/or shipping, if desired, the nesting capability can help avoid the need for conveyors (otherwise needed for moving non-stacking containers during production) means during the manufacturing process. Thus, a relatively small footprint assembly facilities may be used reducing the space, equipment, and/or labor required for forming the packaging. The packaging may be machine folded or folded by hand. The packaging may be partially machine folded and partially folded by hand. The packaging may be partially machine folded, then shipped such that the folding process is completed by hand.

The handle and packaging exhibits a number of qualities and characteristics that allow it to serve well in applications where long distance transport occurs. For example, it is possible that the handle, packaging, or both will be generally liquid resistant and thus also capable to withstand ambient humidity conditions that may occur in transport vehicles, warehouses and/or greenhouses. It may also allow the material to withstand climatic conditions that may change going from one geographic region to another where the distance travelled is more than about 10 km, 100 km, or even 1000 km. Another characteristic is that the packaging is capable of withstanding other harsh conditions typical to shipping and transport such as vibration. The folded packaging may therefore be able to withstand a standardized vibration test for shipping containers such as that set forth in ASTM test method D-999).

The handle and packaging may also include designs or coverings to add a decorative element to the packaging. The handle, the packaging, or both may be covered with a decorative coating that is extruded onto the exterior of the handle and packaging, the interior of the handle and packaging, or both. As an example, the handle material, the packaging material, or both may be covered in a metallic coating (e.g., a metalized polyethylene and/or polyester coating). The handle, the packaging, or both may include a foil covering. The handle, the packaging, or both may also include a coating for projecting a holographic-type image or pattern. Any coating or other design element may be attached to any surface of the handle packaging via an adhesive. Any coating or other design element may be ink jet or laser printed directly onto any surface of the handle or packaging. The design element may include a sleeve that is placed onto the exterior surface of the handle, the packaging, or both. Any surface of the handle or packaging may be embossed, printed, silkscreened, or engraved with a design element. Any design element or coating may be customizable. A customized design element may be added to the handle or packaging at a point of manufacture may be added to the handle or packaging at a point of sale. The customized design element may be added by the consumer. Any coating or design element may include a preloaded adhesive material or other attachment means for simplified placement of the coating or design element onto the handle, the packaging, or both.

The design aspect and generally low cost of the handle and, packaging described herein makes the handle and packaging useful for mass distribution at large events such as weddings, business conferences, school functions and the like. The present teachings thus also contemplate use of the handle and packaging herein for containing gifts, souvenirs, merchandise, promotional items, or the like.

The packaging may therefore also include a covering such as a lid. A covering or lid may include a number of attributes including one or more apertures for providing the entry of items into the packaging. One or more apertures may be included to facilitate maintaining a decorative aspect in contact with the lid. The lid may be modified to allow use of the handle in conjunction with a lid. One or more apertures may be provided so that the handle or another decorative aspect (e.g., a ribbon, bow, or the like) may be fed through the one or more apertures to maintain the handle or decorative aspect in contact with the lid.

Figure 9A:
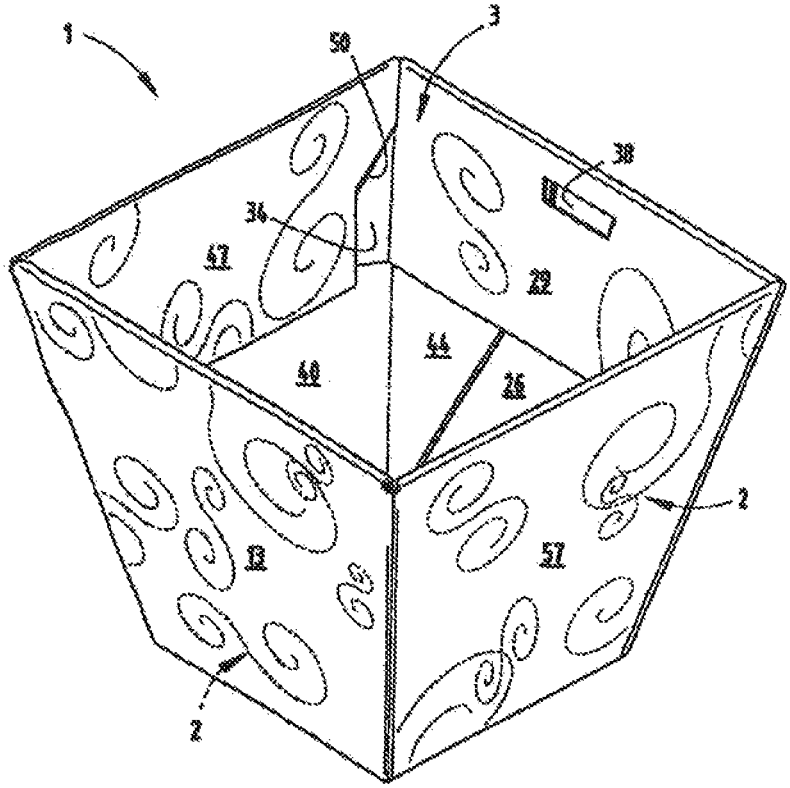
FIG. 9A is a perspective view of an illustrative packaging in accordance with the present teachings

Referring initially to FIGS. 1 and 9A, there is shown an illustrative example of a packaging 1 embodying the present invention, which is formed from a die cut pattern 4 made of a suitable paperboard material. The material may be a CIS (coated one side) SBS (solid bleached sulfate) about 14 point to about 22 point paperboard laminated with a polyethylene film of from about 0.01 mm to about 0.07 mm thick. The material forming the die cut packaging 1 can be poly-coated on both sides or just one side. The opposite surface of the die cut pattern forming the outer surface of the packaging is printed with decorative indicia 2, which can be any type of design. The printing can have a holiday theme, such as Christmas decorations, photographic scenes, a Valentine's Day theme, and any decorative pattern or style desired. Thus, the use of a die cut pattern for forming the packaging 1 allows one side of the material to be printed with practically any desired indicia 2 including foil, textured foil and the like. The resultant, generally trapezoidal packaging 1, as seen in FIG. 9A, has a relatively large rectangular top opening 3 which allows the easy insertion of a pot therein. By providing the generally trapezoidal sides of the packaging 1, a unique design appearance is provided by the packaging which further enhances its aesthetic appearance.

FIG. 1, further shows a die cut pattern integrally including a generally rectangular (e.g., square) base 10, having a first side panel 12 integrally extending therefrom with two gussets 14 and 16. As seen the gussets may resemble two axially symmetric portions such as quadrilateral or generally triangular shaped flap units. An end flap 18 integrally extends from first side panel 12 and includes outwardly extending wings 20 and 22. On the opposite side of base 10 is a second side panel 26 extending from base 10 and integrally including gussets 30 and 32 and an outwardly extending top flap 28. Top flap 28 also includes outwardly extending wings 34 and 36 for locking the packaging in an assembled position as described below. Each of the top flaps 18 and 28 also include a slot 24 and 38, respectively, for securing a pot within the packaging.

Additional side panels 40 and 56 integrally extend from base 10 in a direction generally orthogonal to first and second side panels 12 and 26. Side panel 40 integrally includes gussets 42 and 44 on opposite sides, which adjoin and are integrally coupled to gussets 14 and 30. Side panel 40 includes an outwardly extending end flap 46, which includes laterally extending wings 52 and 54 coupled to the generally rectangular end flap 46 by angled corners 48 and 50. On the opposite side of base 10 is a similar side panel 56 integrally bordered by gussets 58 and 60, which integrally adjoin gussets 16 and 32, respectively. Extending outwardly from side panel 56 is a generally rectangular end flap 62 having of outwardly extending wings 68 and 70 with angled corners 64 and 66, respectively. The integral gussets 14, 42; 16, 58; 30, 44; and 32, 60 form a foldable web between the side panels 12, 26 and 40, 56, as seen in the assembly steps illustrated in FIGS. 3-8.

The phantom lines shown in FIGS. 1-8 represent fold lines for the assembly process, which can either be manual or can be machine assembled if desired. The assembly (i.e., folding) process is shown in FIGS. 2-8 in which first the end flaps 46 and 62 are folded over onto side panels 40 and 56, respectively, in the direction of arrow A in FIG. 2. The inner surfaces of end flaps 46 and 62 may, if desired, be adhesively attached to the inside of side panels 40 and 56. Such step may, however, be unnecessary with the interlocking flaps and wings holding the packaging in an assembled state. The outer surfaces of the panels and flaps shown in FIG. 1 are identified in the remaining drawing figures with the same number incremented by a single digit. Thus, for example, in FIG. 2 the outer surface of end flap 62 is identified as 63.

Figure 3:
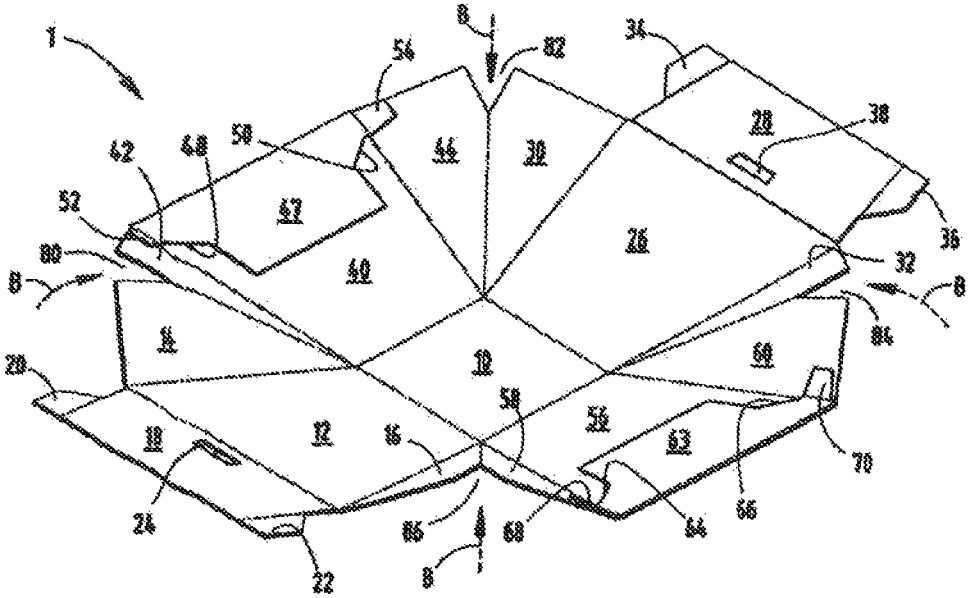
FIG. 3 is a perspective view of the packaging shown in a second step of assembly.

Next, as illustrated in FIG. 3, the adjacent gussets 14, 42, 16, 58, 32, 60, 30, and 44 are deflected inwardly as shown by arrow B in FIG. 3.

Figure 4:
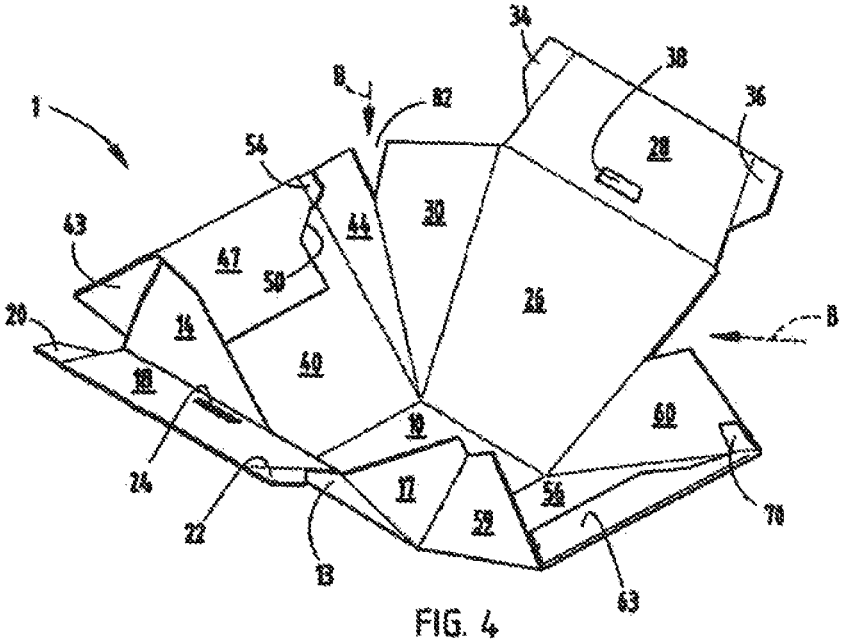
FIG. 4 is a perspective view of a packaging shown in a third step of assembly.
Figure 5:
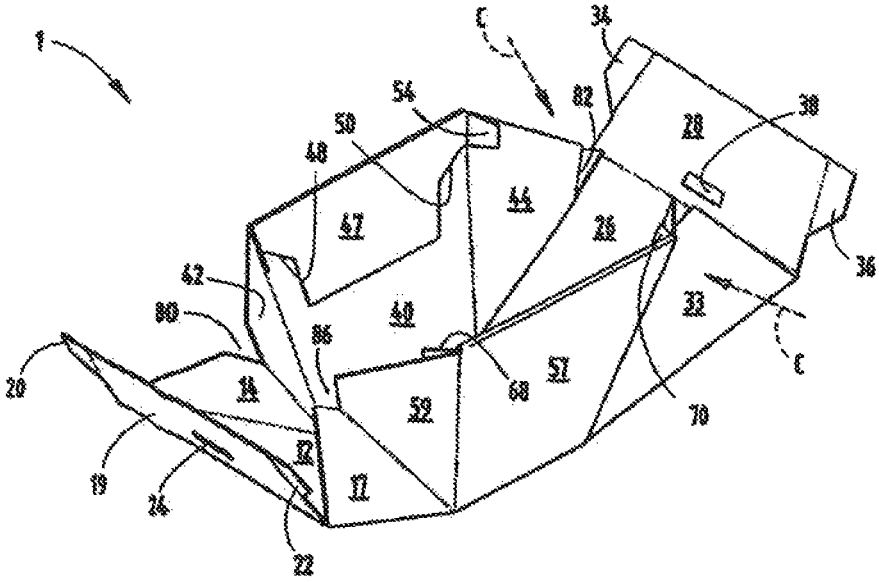
FIG. 5 is a perspective view of a packaging shown in a fourth step of assembly.

This process is continued, as illustrated by arrow B in FIG. 4, until the side panels 40 and 56 are substantially vertical, shown in FIG. 5. The outer surface 57 of side panel 56 is imprinted with indicia 2, as shown in FIG. 9A, are the remaining external surfaces of the packaging 1. With the side panels 40 and 56 substantially in the position shown in FIG. 5, the first and second panels 12 and 26 are then folded inwardly, as indicated by arrow D in FIG. 6, such that the extending wings 68, 70, 52, and 54 project inwardly from side panels 40 and 56 and lie adjacent gussets 58, 60; and 42, 44; respectively.

Figure 6:
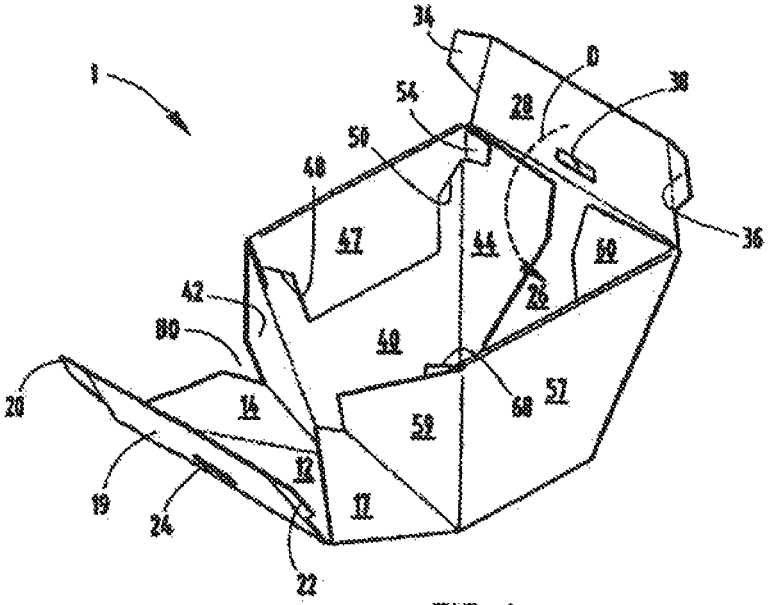
FIG. 6 is a perspective view of a packaging shown in a fifth step of assembly.
Figure 7:
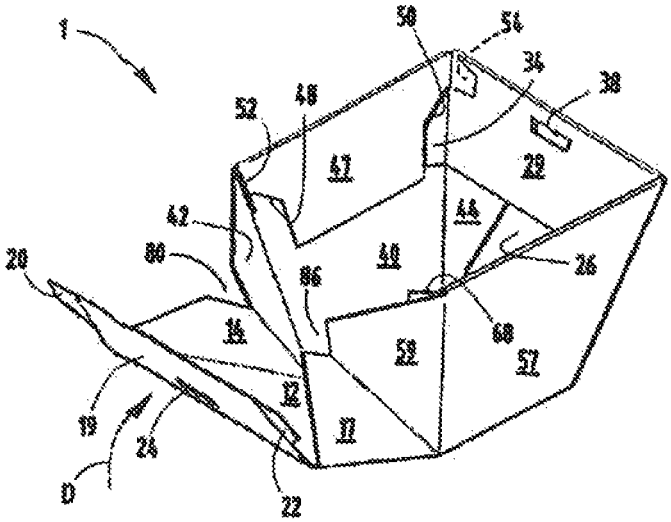
FIG. 7 is a perspective view of a packaging shown in a sixth step of assembly.
Figure 8:
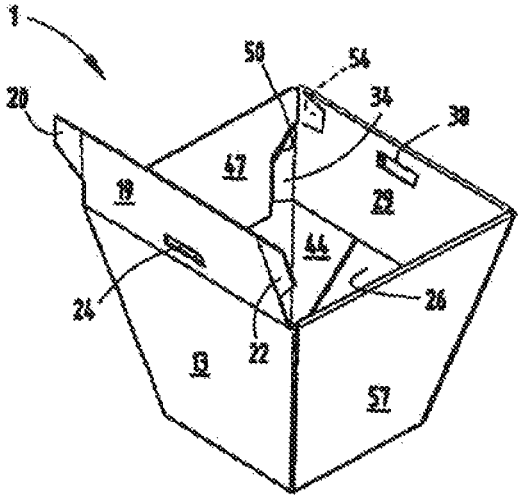
FIG. 8 is a perspective view of a packaging shown in a seventh step of assembly.

Next, the end flaps 18 and 28 are folded over, as shown by arrow D in FIG. 6, and extending wings 34 and 36 and 20 and 22 are tucked over extending wings 52, 54, 68, and 70, respectively, and under and flaps 46 and 62, as seen in FIGS. 7 and 8, to interlock the edges of the packaging to a completely assembled position as shown in FIG. 9A. The outer surface 13 of first side panel 12 likewise is imprinted with indicia 2 as are the remaining outer surfaces, including the outer surfaces 47 of end flap 46, 63 of end flap 62, surface 19 of end flap 18 and surface 29 of flap end 28. Thus, the exposed surfaces of packaging 1 which are visible, including the outer surfaces of the cover itself, and the inner surfaces of the flaps which are exposed when looking downwardly from the top edge of the cover may be decoratively imprinted. The indicia 2 can be printed in any commercially known manner. The slots 24 and 38 in and flaps 18 and 28, respectively, aid in securing a pot within the packaging.

Thus, by providing extending wings 52, 54, 68, and 70 with extending wings 20, 22 and 34, 36 folded over and under end flaps 46 and 62, respectively, the top edges of the packaging interlock. By providing the V-shaped slots 80, 82, 84, and 86 between adjacent gussets 14, 42; 44, 30; 32, 60; and 16, 58 respectively, clearance is provided for the extending wings and gussets to allow the ready assembly of the packaging. Slots 24 and 38 are interior of the packaging and therefore, are relatively unobtrusive and do not detract from the ornamental appearance of the resultant packaging when assembled as seen in FIG. 9A.

Figure 9B:
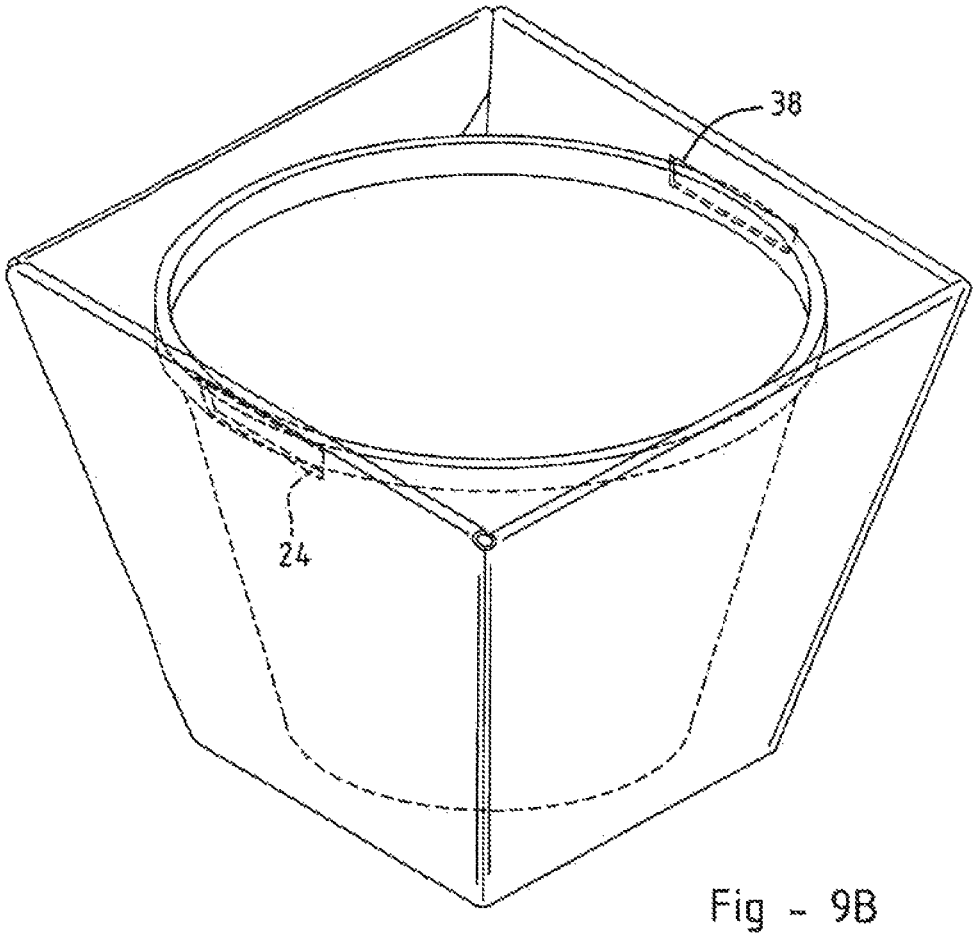
FIG. 9B is a perspective view of an illustrative packaging shown with a plant pot located within the packaging.
Figure 9C:
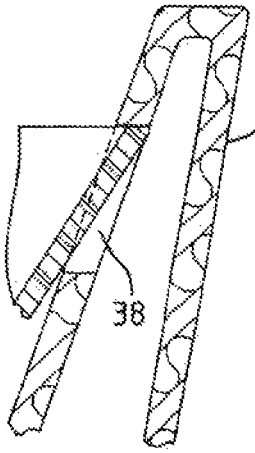
FIGS. 9C and 9D are illustrative cross sectional views of contact between the packaging and an item within the packaging.
Figure 9D:
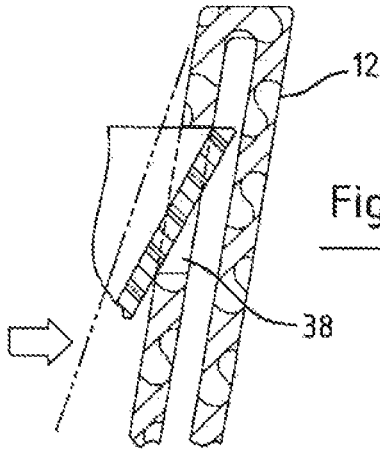

As shown for example in FIG. 9B, packaging may contain a pot for holding a plant. The slots 24, 38 are shown including a top edge and a bottom edge so that the top edge of each slot contacts the plant pot and holds the pot in place.

Figure 12A:
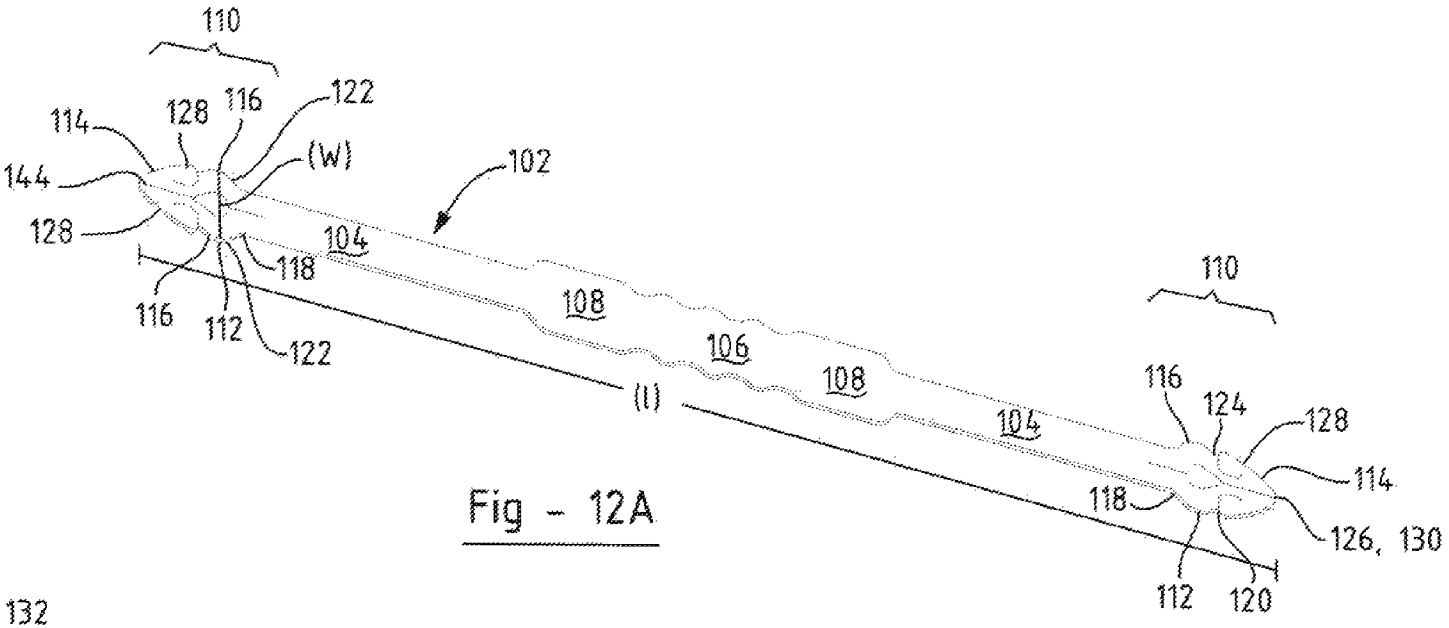
FIGS. 12A and 12B show perspective views of illustrative handles in accordance with the present invention.
Figure 12B:
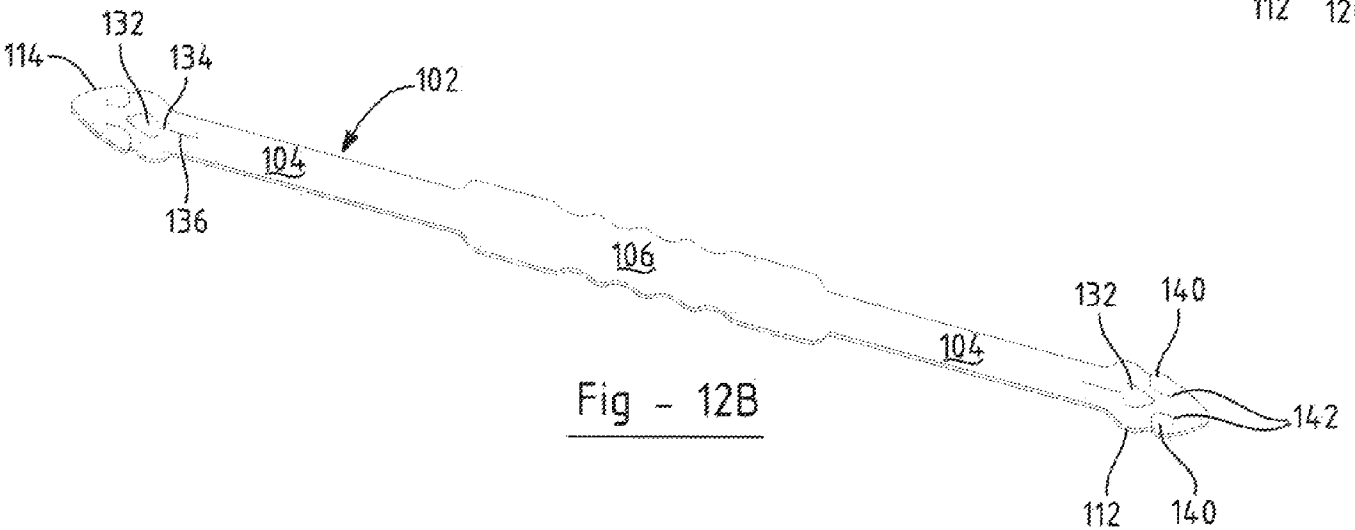

The packaging may also include a handle 102 as shown for example in FIGS. 12A and 12B. The handle 102 includes an elongated strip 104 having a length (l) and including a gripping portion 106. Adjacent the gripping portion 106 are one or more widened portions 108. The handle may also include two and portions 110, the and portions 110 including a bulbous portion 112 and a narrowing head portion 114. The bulbous portion 112 may include one or more protrusions 116 having a width (w) that is greater than the width of any portion adjacent the bulbous portion. The bulbous portion includes a top edge 118, a bottom edge 120, and two side edges 122. The narrowing head portion 114 is located adjacent the bulbous portion 112 and includes a top edge 124, a bottom edge 126, and two side edges 128. The bottom edge 126 of the narrowing head portion may be the terminating end 130 of the handle. The side edges 128 of the narrowing head portion may be angled toward one another so that the width of the narrowing head portion decreases toward the terminating end 130 of the handle.

As discussed above, the handle 102 may also include one or more openings to facilitate attachment of the handle to the packaging. As shown in FIG. 12B, the bulbous portion 112 includes a cut-out 132 having one or more terminating edges 134 of the cut-out out still attached to the bulbous portion 112. Adjacent the cut-out 132, the end portion may include a pre-formed crease 136 to facilitate flexing of the end portion 110 when engaging the handle with the packaging. The narrowing head portion 114 may also include one or more openings. Along each side edge 138 of the narrowing head portion 114, one or more openings may be cut to form tab structures 140. The tab structures 140 may be formed so that at least one terminating edge 142 of the tab structure is still attached to the narrowing head portion. The tab structures 140 may also facilitate engagement of the handle with the packaging. In addition to the tab structures, the narrowing head portion may include an additional opening 144 (shown at FIG. 12A) for allowing the head portion to bend upon engagement with the packaging so that the end portion does riot tear during use. FIG. 12B shows an embodiment where the additional opening 144 is not included.

Figure 13:
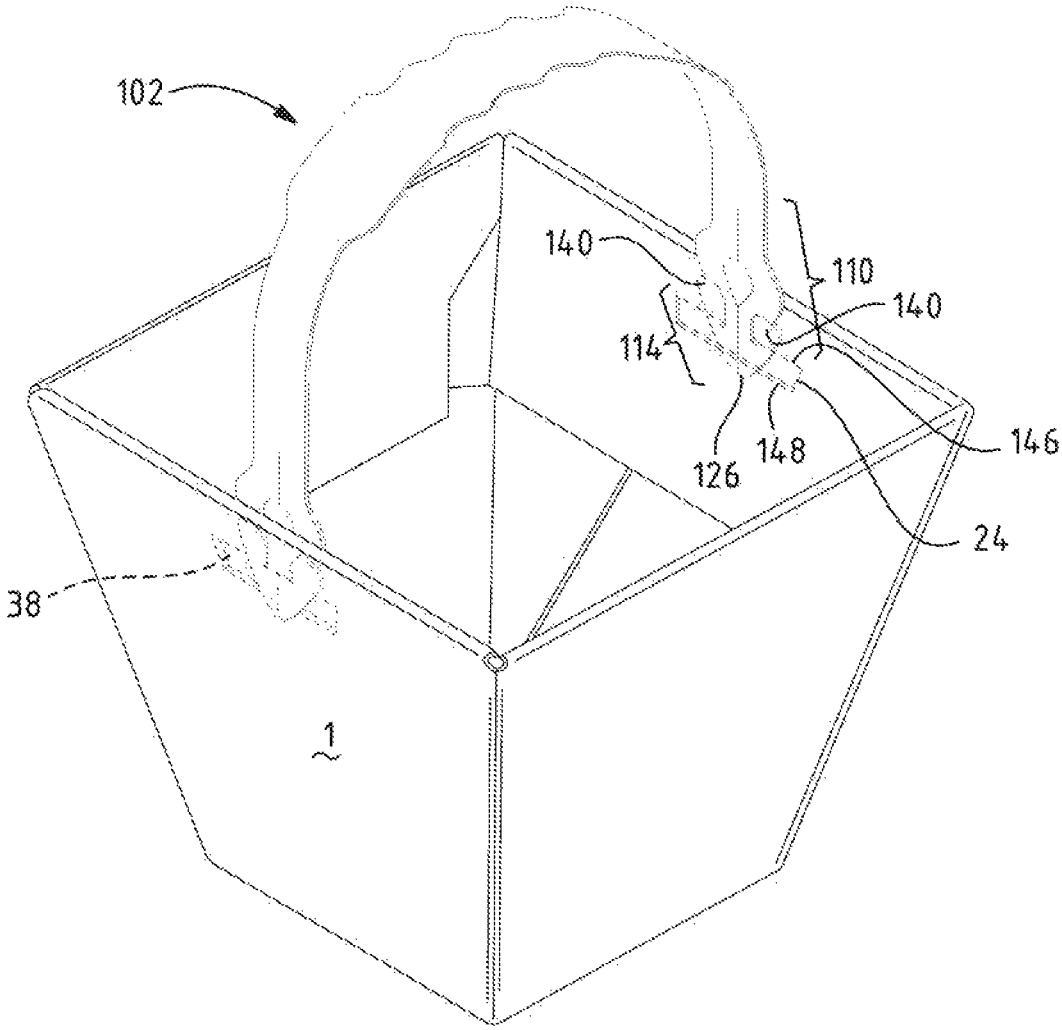
FIG. 13 is a perspective view of an illustrative packaging shown with the handle of FIG. 12 attached to the packaging via the article retention structures.

As shown in FIG. 13, the handle 102 may be placed contact with the packaging 1. Specifically, the end portions 110 of the handle 102 may be placed into the article retention structures 24, 38. The article retention structures 24, 38 may be formed as slots within the packaging, each having a top edge 146 and a bottom edge 148. Upon placement of an end portion within an article retention structure, the narrowing had portion 114 may be placed downward into the article retention structure so that initially, the narrowing head portion, including the tab structures 140, is located below the bottom edge 148 of the article retention structure. In order to lock the handle into place, the end portion 110 may then be pulled upward so that the tab structures 140 are located behind the top edge 146, while the bottom edge 126 of the narrowing head portion (e.g., the terminating end of the handle 130) remains behind the bottom edge 148 of the article retention structure. Upon placement of the end portion into the article retention structure, the width of the end portion 110 at its widest point may be greater than the width of article retention structure. Thus, the end portion may be temporarily flexed (e.g., deformed) so that the width of the end portion at its widest point is sufficiently reduced to fit the and portion into the article retention structure. Upon placement of the end portion into the article retention structure, the end portion can be released (e.g., no longer flexed) which will further assist in locking the end portion within the article retention structure.

Figure 15:
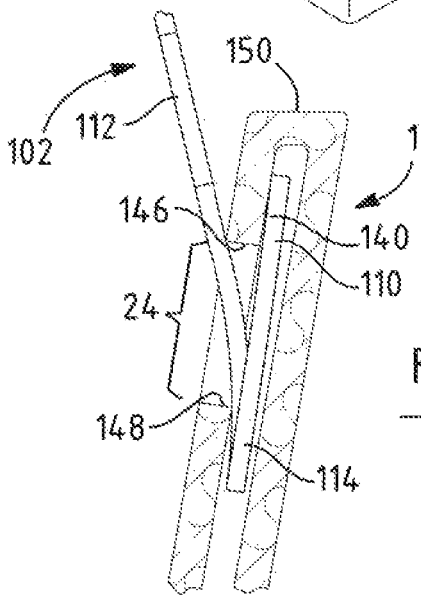
FIG. 15 is an illustrative cross sectional view of contact between the handle of FIG. 12 and the article retention structure.

FIG. 15 shows a cross sectional view of the end portion 110 of the handle 102 being placed within the article retention structure 24. The tab structures 140 are located behind the top edge 146 of the article retention structure and the bottom edge 126 of the narrowing head portion 114 is located behind the bottom edge 148 of the article retention structure. Thus, when the handle 102 is pulled upward the tab portions 140 remain engaged within the article retention structure 24 so that the tab structures cannot move upward beyond the top folded edge 150 of the packaging. Further, once the upward force on the handle is released, the contact of the bulbous portion 112 of the handle with the top edge 146 and bottom edge 148 of the article retention structure may prevent the end portion from slipping downward so that the tab portions 140 do not fall below the top edge 146 of the article retention structure.

Figure 14:
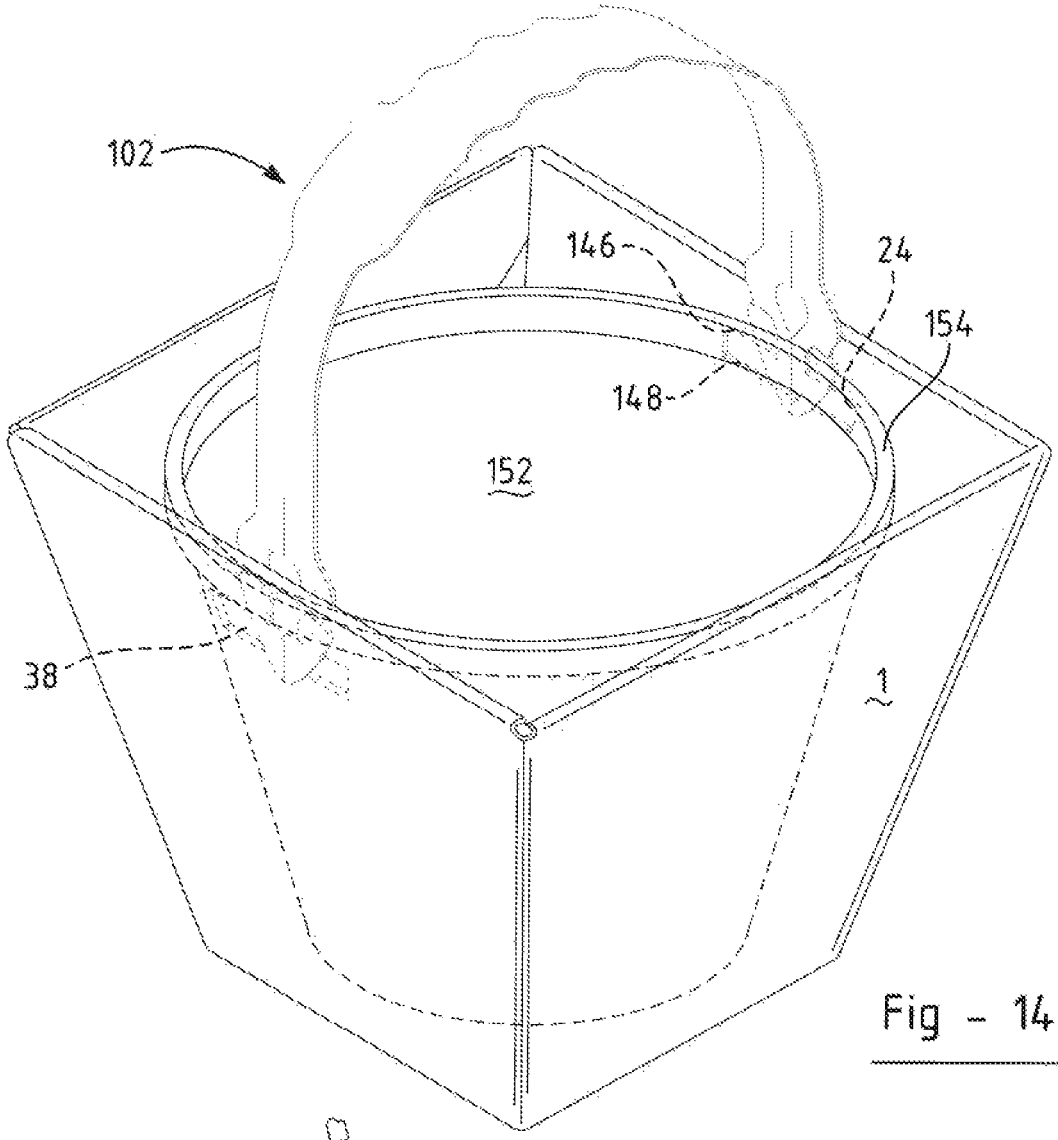
FIG. 14 is a perspective view of an illustrative packaging shown with a plant pot located within the packaging and the handle of FIG. 12 attached to the packaging via the article retention structures.

FIG. 14 shows use of the handle 102 when a pot 152 is placed into the packaging 1. The article retention structures 24, 38 may engage either the handle or the pot. When the handle 102 is engaged within the article retention structures, the top edge of the pot 154 may be prevented from contacting the top edge 146 of the article retention structure. Thus, when the handle is engaged within the article retention structure, the pot may not be locked into place within the packaging. However, upon removal of the handle from within the article retention structures, the pot may then be locked into place within the packaging by locating the top edge of the pot 154 within the article retention structure 24. In the event that it is necessary to again engage the handle within the article retention structures, the top edge of the pot 154 may be disengaged from the article retention structure and the end portions of the handle can then be placed within the article retention structures.

The packaging 1 is preferably made to accommodate a variety of sized pots. As an example, for a 15 cm pot, the base 10 may be approximately from about 9 cm to about 12 cm on each side while the side panels may have a height of approximately from about 12 cm to about 15 cm and a width at the top from abut 14 cm about 16 cm. The overlapping and interlocking end flaps 18, 28, 46 and 62 may extend downwardly into the packaging approximately from about 5 cm to about 7 cm.

Though not necessarily drawn to scale geometries, relative proportions and dimensions shown in the drawings are also part of the teachings herein, even if not explicitly recited. However, unless otherwise stated, nothing shall limit the teachings herein to the geometries, relative proportions and dimensions shown in the drawing.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the contest of only one of the illustrated embodiments, such feature may be combined with one more other features of other embodiments, for any given application. It will also be appreciated from the above that the fabrication of the unique structures herein and the operation thereof also constitute methods in accordance with the present invention.

The preferred embodiment of the present invention has been disclosed. A person ordinary skill in the art would realize however, that certain modifications would come within the teachings of this invention. Therefore, the following claims should be studied to determine the true scope and content of the invention.

The explanations and illustrations presented herein are ended to acquaint others skilled in the art with the invention its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the invention. The scope of the invention should therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

What is claimed is:

1. A packaging comprising:

a base portion;

a plurality of side walls;

at least one inwardly folded gusset attached to and disposed between the adjoining side walls;

at least two of the sidewalls each including at least one inwardly folded free end flap portion that includes at least one article retention structure integrally formed in the at least one free end flap for engaging a handle that includes:

(i) a grasping portion;

(ii) two end portions located adjacent the grasping portion and having a narrowing head portion with flexible tabs located on opposing side edges of the head portion and a bulbous portion located adjacent the head portion:

wherein:

(i) the article retention structure is concealed from exterior side viewing; and (ii) the article retention structure includes at least one slot defined in the at least one free end flap portion that has an upper edge so that flexible tabs of the handle are maintained behind the upper edge so that upon application of upward force to the handle the head portion remains within the article retention structure.

2. The packaging of claim 1, wherein a folded edge does not contact any integrated lid structure.

3. The packaging of claim 1, wherein all gussets of the packaging are folded inwardly so that they are generally not visible from external side viewing.

4. The packaging of claim 1, wherein second ends of each adjoining side wall define an open top having a perimeter and the packaging includes the generally rectangular base portion having a perimeter that is smaller than the perimeter of the open top, and includes the plurality of tapered side walls that are shaped generally as isosceles trapezoids that are located between the rectangular base portion and the at least one radially projecting free end flap portion.

5. The packaging of claim 1, wherein the at least one inwardly folded free end flap portion includes at least one securing structure including at least one wing having at least one generally straight edge, that projects laterally from the at least one inwardly folded free end flap portion and that operates to achieve an interference engagement by a bearing relationship between a surface and the at least one generally straight edge.

6. The packaging of claim 1, wherein the packaging includes one or more score lines that radiate outwardly from corners of the base portion and wherein the one or more score lines are scored to include an outer portion and an inner portion, and the outer portion folds with less applied force than the inner portion to define a more precise fold.

7. The packaging of claim 1, wherein at least one or more score lines that radiate outwardly from the corners of the rectangular base include a perforated portion that extends at least about 10% of the length of the at least one or more score lines and is located at the radial outermost end of the at least one or more score lines.

8. The packaging of claim 1, wherein the entirety of a scoring has a depth that is sufficiently deep to allow folding, but not so deep that prior to or during folding a water resistant material on the packaging will rupture.

9. The packaging of claim 1, wherein the article retention structure integrally formed in the at least one free end flap for engaging the handle may be utilized to maintain an item within the packaging upon removal of the handle from the packaging.

10. A packaging comprising:

a base portion;

a plurality of side walls;

at least one inwardly folded gusset attached to and disposed between the adjoining side walls;

at least two of the sidewalls each including at least one inwardly folded free end flap portion that includes at least one article retention structure integrally formed in the at least one free end flap for engaging a handle that includes:

i. an elongated strip;

ii. a gripping portion centrally located on the elongated strip;

iii. one or more widened portions adjacent the gripping portion;

iv. two end portions located at the terminating ends of the elongated strip, wherein the two end portions include:

v. a bulbous portion having a top edge and a bottom edge; and vi. a narrowing head portion adjacent the bottom edge of the bulbous portion and having two side edges that each include a tab portion;

wherein:

i. the article retention structure is concealed from exterior side viewing; and ii. the article retention structure includes a slot defined in the at least one free end flap portion that has an upper edge so that flexible tabs of the handle are maintained behind the upper edge so that upon application of upward force to the handle the narrowing head portion remains within the at least one article retention structure.

11. The packaging of claim 10, wherein a folded edge does not contact any integrated lid structure.

12. The packaging of claim 10, wherein all gussets of the packaging are folded inwardly so that they are generally not visible from external side viewing.

13. The packaging of claim 11, wherein second ends of each adjoining side wall define an open top having a perimeter and the packaging includes a the generally rectangular base portion having a perimeter that is smaller than the perimeter of the open top, and includes the plurality of tapered side walls that are shaped generally as isosceles trapezoids that are located between the rectangular base portion and the at least one radially projecting free end flap portion.

14. The packaging of claim 10, wherein the at least one inwardly folded free end flap portion includes at least one securing structure including at least one wing having at least one generally straight edge, that projects laterally from the at least one inwardly folded free end flap portion and that operates to achieve an interference engagement by a bearing relationship between a surface and the at least one generally straight edge.

15. The packaging of claim 10, wherein the packaging includes one or more score lines that radiate outwardly from corners of the base portion and wherein the one or more score lines are scored to include an outer portion and an inner portion, and the outer portion folds with less applied force than the inner portion to define a more precise fold.

16. The packaging of claim 10, wherein at least one or more score lines that radiate outwardly from the corners of the rectangular base include a perforated portion that extends at least about 10% of the length of the at least one or more score lines and is located at the radial outermost end of the at least one or more score lines.

17. The packaging of claim 10, wherein the entirety of a scoring has a depth that is sufficiently deep to allow folding, but not so deep that prior to or during folding a water resistant material on the packaging will rupture.

18. The packaging of claim 10, wherein at least a portion of the base portion, at least a portion of the plurality of side walls, and at least a portion of the handle are made out of a liquid-resistant material.

19. The packaging of claim 10, wherein the bulbous portion of the handle includes one or more protrusions having a width that is greater than the width of any portion adjacent to the bulbous portion.

20. The packaging of claim 10, wherein the article retention structure integrally formed in the at least one free end flap for engaging the handle may be utilized to maintain an item within the packaging upon removal of the handle from the packaging.

* * * * *

UNITED STATES PATENT AND TRADEMARK OFFICE

CERTIFICATE OF CORRECTION

PATENT NO. : 8,550,331 B2
APPLICATION NO. : 13/112639
DATED : October 8, 2013
INVENTOR(S) : Smith et al.

It is certified that error appears in the above-identified patent and that said Letters Patent is hereby corrected as shown below:

Title Page 2, column 2, under item (56) Non-Patent Literature Documents, under Foreign Patent Documents insert:

-- "Related PCT Utility Patent Application No. US09/64420, filed November 13, 2009; Published as WO2011/037594 on March 31, 2011 (1523-002 WO)"

"Related Utility Patent Application No. 12/566,766, filed September 25, 2009; Published as US 2011/0072719 A1 on March 31, 2011; Issued as US 7,959,061 on June 14, 2011 (1523-002)"

"Related Utility Patent Application No. 12/618,395, filed November 13, 2009; Issued as US Patent No. 7,870,995 on January 18, 2011 (1523-002C1)"

Related Utility Patent Application No. 12/976,065 filed December 22, 2010; Published as US 2011/0089227 A1 on April 21, 2011 (1523-002C2)"

"Related Utility Patent Application No. 13/225,794 filed September 6, 2011; Published as US 2012/0125804 A1 on May 24, 2012 (1523-002C3)"

"Related Design Patent Application No. 29/344,203, filed September 25, 2009; Issued as Design Patent No. D630,548 on January 11, 2011 (1523-004)" --

Signed and Sealed this
Nineteenth Day of November, 2013

Teresa Stanek Rea

Teresa Stanek Rea
*Deputy Director of the United States Patent and Trademark Office*